US012065852B2

(12) United States Patent
Valentine

(10) Patent No.: US 12,065,852 B2
(45) Date of Patent: Aug. 20, 2024

(54) POOL PRIVACY PARTITION SYSTEM

(71) Applicant: Jamie Valentine, Van Wert, OH (US)

(72) Inventor: Jamie Valentine, Van Wert, OH (US)

( * ) Notice: Subject to any disclaimer, the term of this patent is extended or adjusted under 35 U.S.C. 154(b) by 272 days.

(21) Appl. No.: 17/841,636

(22) Filed: Jun. 15, 2022

(65) Prior Publication Data

US 2023/0407657 A1 Dec. 21, 2023

(51) Int. Cl.
*E04H 4/10* (2006.01)

(52) U.S. Cl.
CPC ..... *E04H 4/108* (2013.01)

(58) Field of Classification Search
CPC ..... E04H 15/64; E04H 15/322; E04H 4/10; E04H 4/06; E04H 4/108; E04H 15/00; E04H 15/44
USPC ..... 160/340
See application file for complete search history.

(56) References Cited

U.S. PATENT DOCUMENTS 451,331 A * 4/1891 Lee ..... E04H 15/44 135/96
1,127,087 A * 2/1915 Phillips ..... E04H 15/44 135/96
2,928,405 A * 3/1960 Lawson ..... E04H 15/003 D25/56
3,263,692 A * 8/1966 Questi ..... E04H 15/44 135/118
4,730,423 A * 3/1988 Hughes ..... E04H 15/58 52/27
5,579,796 A * 12/1996 Mallo ..... E04H 6/025 52/63
6,213,138 B1 * 4/2001 Wimpee ..... E04H 15/44 135/156
9,777,508 B2 * 10/2017 Kalvani ..... E04H 15/54
11,035,146 B1 * 6/2021 Bernard ..... E04H 15/44
2002/0069903 A1 * 6/2002 Hewett ..... E04H 15/44 135/121
2005/0194029 A1 * 9/2005 Goldwitz ..... E04H 15/322 135/98
2006/0283493 A1 * 12/2006 Charles ..... E04H 15/44 135/121
2013/0032186 A1 * 2/2013 Lin ..... E04H 15/58 135/96
2013/0061898 A1 * 3/2013 Webster ..... E04H 15/24 135/156
2014/0041703 A1 * 2/2014 Funston ..... E04H 15/54 135/121
2015/0136191 A1 * 5/2015 Carbaugh ..... E04H 15/34 135/120.3
2017/0320546 A1 * 11/2017 Greer ..... E04H 15/58
2019/0116947 A1 * 4/2019 Kuypers ..... A45B 17/00
2020/0095796 A1 * 3/2020 Huffman ..... A45B 23/00
(Continued)

*Primary Examiner* — Beth A Stephan

(57) ABSTRACT

A privacy shade partition system is provided. The system may utilize a plurality of frame members adjustably coupled to one another. Each of the plurality of frame members may have a plurality of attachment points permanently coupled thereto. Further, the plurality of frame members may be adjustably coupled to one another via a plurality of interlocking adjustment mechanisms. The system may additionally utilize a plurality of legs coupled to the plurality of frame members. Each of the plurality of legs may comprise a bracket coupling mechanism adjustably coupled thereto. Further, the system may have a privacy shade coupled to each of the plurality of attachment points.

20 Claims, 7 Drawing Sheets

(56) References Cited

U.S. PATENT DOCUMENTS

| | | | | |
|---|---|---|---|---|
| 2020/0232244 | A1* | 7/2020 | Zanot | E04H 15/322 |
| 2020/0240169 | A1* | 7/2020 | Sun | E04H 15/46 |
| 2021/0123261 | A1* | 4/2021 | Regus | E04H 15/44 |
| 2021/0386054 | A1* | 12/2021 | Arkenau | A01M 31/025 |
| 2021/0404209 | A1* | 12/2021 | Martinek | E04H 15/44 |
| 2022/0010580 | A1* | 1/2022 | Graham | E04H 15/04 |
| 2022/0042341 | A1* | 2/2022 | Pancake | E04H 13/001 |

* cited by examiner

300

400b

400c

POOL PRIVACY PARTITION SYSTEM

BACKGROUND OF THE INVENTION

Swimming pools are ubiquitous throughout both public and private settings in society. Specifically, there are an estimated 300,000 public pools of some form and over 10 million residential pools within the United States with an estimated total market size of $1.3 billion. The two main types of swimming pools are above-ground construction swimming pools and in-ground construction swimming pools. The size of swimming pools may vary greatly from a small residential backyard pool to an olympic-length swimming pool at a public outdoor facility.

People enjoy using swimming pools in order to get sun exposure, practice physical exercise, host social events, enjoy recreational time and the like. The use of a swimming pool for any of these purposes typically requires the user to wear a bathing suit. Many bathing suits are physically revealing of the user's body relative street clothes worn in the public. Therefore, use of a swimming pool may leave the user feeling rather exposed when use of the swimming pool is in view of others such as neighbors or members of the public. It would be advantageous to provide a form of privacy for those users feeling exposed while not diminishing the previously outlined beneficial aspects of swimming pool use.

During use of the swimming pool, a user may experience heat stroke or other forms of overheating due to overexposure to the sun. In some climates and times of year, direct sun exposure can be a nuisance even when using the pool. Trees, umbrellas, adjacent building structures and the like are often used to provide additional sun protection for the user. Alternatively, users may resort to wearing short or long-sleeved t-shirts and sun-shading hats to avoid sun overexposure while using the swimming pool.

Further, some users may apply high SPF sun lotions or sprays before and during their use of the swimming pool. However, such sun lotions are prone to wear off the user's skin as the user sweats and swimming pool water erodes the lotion layer. Additionally, use of high SPF sun lotions does not allow the user's skin to absorb any sunlight that provides essential vitamin to the user's body. Therefore, it would be advantageous to provide a shading element for users of the swimming pool that simultaneously offers privacy.

Known shading elements, such as trees, umbrellas, adjacent building structures and the like, typically provide inadequate shade in that they either provide too much shade or too little shade. Too much shade can make the portion of the swimming pool cold to the user and does not allow the user to absorb any sunlight at all. Too little shade can provide sun overexposure to the user and make that portion of the pool unenjoyable. Therefore, it would be advantageous to provide a shading element that provides equivalent SPF protection that allows for absorption of a beneficial amount of sunlight providing vitamin D without causing overexposure.

Additionally, such known shading elements are not easily portable or movable in nature and so may only provide shade during certain portions of the day or certain periods of the year. Not being able to move a shading element or having to incur great burden to move the shading element may reduce the enjoyability of the swimming pool for the user. Therefore, it would be advantageous to provide a shading element that is modular and portable in nature that allows one or more shading elements to be moved to desired portions of the swimming pool such that each shading element provides equal functional benefit.

Given both above-ground construction and in-ground construction swimming pools are commonly utilized, the same preceding problems are of equal concern to each type of construction. A typical above-ground construction pool utilizes one or more raised vertical wall panels enclosing a body of water and having a plurality of horizontally arranged capping structures that sit atop the one or more wall panels. A typical in-ground construction pool utilizes a foundational structure shaped as desired forming a cavity which is filled with water. Each type of construction may utilize a guard railing running along the perimeter of the pool. Therefore, it would be advantageous to provide a shade element that is designed to accommodate a diversity of coupling structures found in both types of construction.

Given the diverse structural design of above-ground and in-ground pools and the variation in size within each type, there arises a need to provide privacy and shade in a portable modular manner for as many different types of pool structures as possible without requiring multiple different shading element designs. For instance, if it is desired for the shade element to couple to the capping structure of an above-ground pool, then a small above-ground pool with shorter length capping structures would require a shorter length shade element to provide complete coverage for that length of pool. A larger above-ground pool with longer length capping structures, however, would require a longer length shade element to provide complete coverage for that length of pool. Therefore, it would be advantageous to provide a shade element that is length and width-adjustable to meet the needs of the given pool structure.

In the event that a length and width-adjustable shade element is desired, there are no existing solutions for providing a privacy shade material that will adjust in the length and width dimensions while still providing the structural integrity required for providing both privacy and shade. Typical materials privacy shade materials are not length and width-adjustable or, if they are, do not maintain functionality as a privacy shade upon being stretched beyond a threshold point in the length and/or width dimensions. Therefore, it would be advantageous to provide a privacy shade material that allows for greater length and width-adjustability by having a larger tolerance threshold for length and width-adjustment while still functioning as a privacy shade.

Many existing privacy shade structures are not robust to inclement weather and are prone to damage in the event of high winds given their structural profile. Specifically, the planar non-porous structure of most privacy shades causes the privacy shade to have too much surface area exposed to an incident vector of high magnitude wind which causes the privacy shade to become decoupled from the swimming pool and to fly off as a potentially dangerous projectile. Therefore, it would be advantageous to provide a privacy shade structure that is at least semi-porous to incident fluids such that it maintains structural integrity in the face of high winds. Further, it would be advantageous to provide a privacy shade structure that may rotate at its coupling point with the pool structure to allow the privacy shade to fold down parallel with the surface of the pool water which reduces the chances of wind-related damage and allows the user to cover the pool with any type of pool storage cover while the privacy shade structure is still coupled to the pool structure.

DETAILED DESCRIPTION OF THE INVENTION

Figure 1:
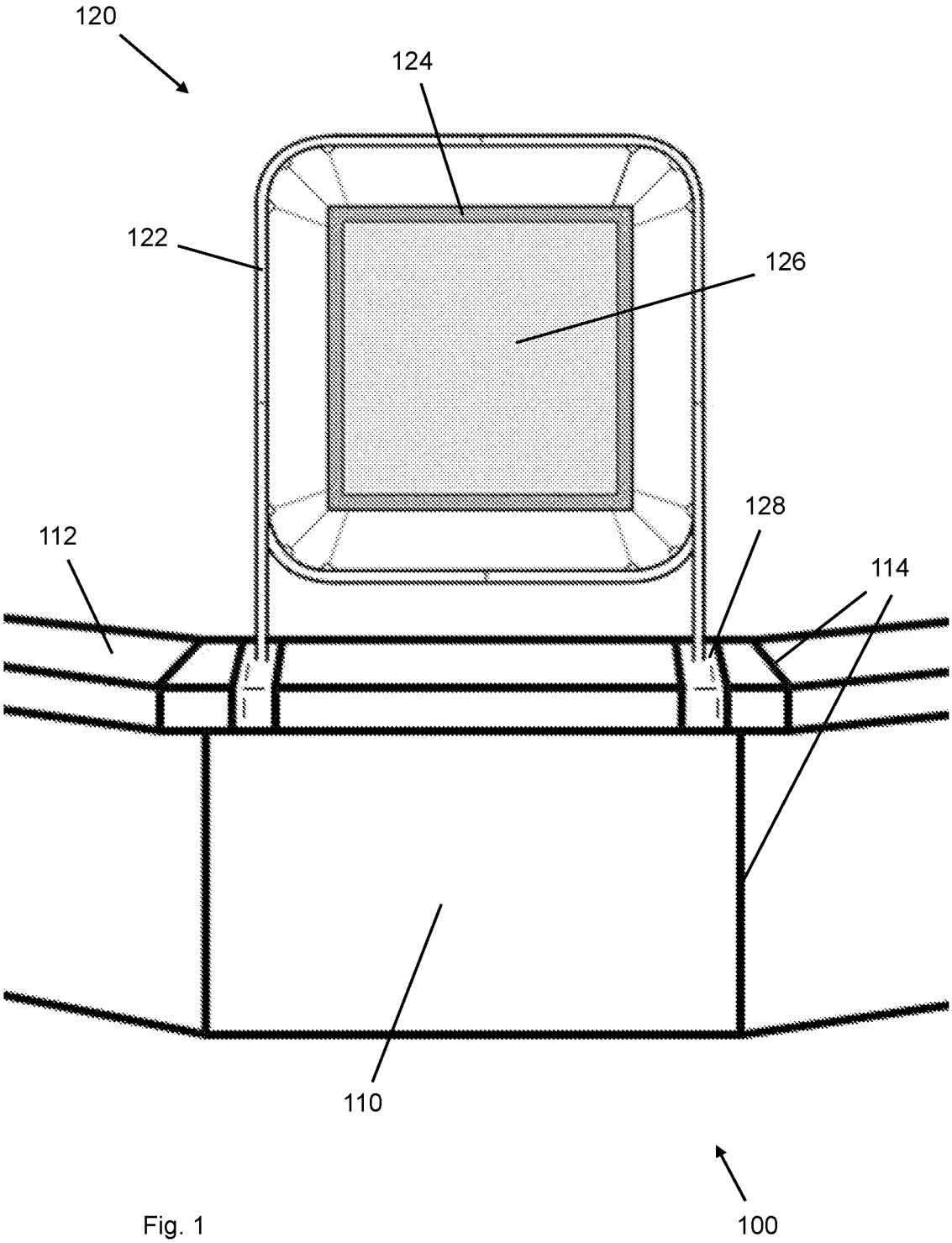
FIG. 1 illustrates an overview of a privacy shade partition system coupled to an end cap member of a swimming pool in accordance with some embodiments of the present invention.

Before describing the present invention in detail, it is to be understood that the invention is not limited to any one of the particular embodiments, which of course may vary. It is also to be understood that the terminology used herein is for the purpose of describing particular embodiments only, and therefore is not necessarily intended to be limiting. As used in this specification and the appended claims, terms in the singular and the singular forms "a," "an," and "the" include plural referents unless the context clearly dictates otherwise. Thus, for example, reference to "a privacy shade partition system" also includes a plurality of privacy shade partition systems and the like.

In some embodiments, a privacy shade partition system is provided comprising a plurality of frame members adjustably coupled to one another, wherein: each of the plurality of frame members comprise a plurality of attachment points permanently coupled thereto, and the plurality of frame members are adjustably coupled to one another via a plurality of interlocking adjustment mechanisms; a plurality of legs coupled to the plurality of frame members, wherein each of the plurality of legs comprises a bracket coupling mechanism adjustably coupled thereto; a privacy shade coupled to each of the plurality of attachment points.

In some embodiments, each of the plurality of frame members comprise a horizontal portion and a vertical portion.

In some embodiments, the horizontal and vertical portions couple together at a corner point, and the corner point comprises a single orthogonal joint forming a 90 degree angle.

In some embodiments, the horizontal and vertical portions couple together at a corner point, and the corner point comprises a continuous rounded corner enclosing 90 degrees of arc.

In some embodiments, each of the plurality of frame members comprise a male terminal end and a female terminal end.

In some embodiments, each of the plurality of frame members are adjustably coupled to one another via insertion of the male terminal ends of the plurality of frame members into the female terminal ends of the plurality of frame members.

In some embodiments, each of the plurality of interlocking adjustment mechanisms are disposed at locations where the male terminal ends are inserted within the female terminal ends.

In some embodiments, each of the plurality of interlocking adjustment mechanisms comprises a plurality of serially arrayed apertures formed symmetrically within the male and female terminal ends of the plurality of frame members; and a locking pin.

In some embodiments, each of the plurality of legs comprise a rotatable coupling mechanism coupled to a bracket coupling mechanism via a rotational base member.

In some embodiments, the rotatable coupling mechanism rotates about the rotational base member through an angle of at least 90 degrees.

In some embodiments, the rotatable coupling mechanism comprises an elongate shaft having a first plurality of serially arrayed apertures formed symmetrically therein.

In some embodiments, the elongate shaft couples to one of the plurality of legs via paired alignment of the first plurality of serially arrayed apertures with a second plurality of serially arrayed apertures formed symmetrically within the leg and insertion of a locking pin through one of the aligned pairs of apertures of the first and second plurality of serially arrayed apertures.

In some embodiments, the privacy shade comprises a coupling perimeter enclosing a semi-porous screen.

In some embodiments, the coupling perimeter comprises a plurality of coupling apertures.

In some embodiments, each of the plurality of coupling apertures are coupled to a respective attachment point of the plurality of attachment points.

In some embodiments, the semi-porous screen comprises a mesh structure having arrayed apertures formed therein with uniform pitch and spacing.

In some embodiments, the arrayed apertures do not provide a visible line of sight through the semi-porous screen at a viewpoint greater than 10 feet therefrom.

In some embodiments, the arrayed apertures provide a visible line of sight through the semi-porous screen at a viewpoint less than 10 feet therefrom.

In some embodiments, a privacy shade partition system is provided comprising a plurality of frame members adjustably coupled to one another, wherein: each of the plurality of frame members comprise a horizontal portion and a vertical portion arranged orthogonal relative one another and permanently coupled together at a corner point, each of the plurality of frame members comprise a plurality of attachment points permanently coupled thereto, wherein at least one of the plurality of attachment points are disposed at the corner point, and each of the plurality of frame members are adjustably coupled to one another via an interlocking adjustment mechanism; a plurality of legs coupled to the plurality of frame members, wherein each of the plurality of legs comprises a bracket coupling mechanism adjustably coupled thereto; and a privacy shade coupled to each of the plurality of attachment points.

In some embodiments, a privacy shade partition system is provided comprising a plurality of frame members adjustably coupled to one another, wherein: each of the plurality of frame members comprise a horizontal portion and a vertical portion, each of the plurality of frame members comprise a plurality of attachment points permanently coupled thereto, wherein at least one of the plurality of attachment points are coupled to the horizontal portion and at least one of the plurality of attachment points are coupled to the vertical portion, and each of the plurality of frame members are adjustably coupled to one another via an interlocking adjustment mechanism; a plurality of legs coupled to the plurality of frame members, wherein each of the plurality of legs comprises a bracket coupling mechanism adjustably coupled thereto; and a privacy shade coupled to each of the plurality of attachment points Exemplary embodiments of the present invention are illustrated in the accompanying figures. As shown in FIG. 1, an overview of a privacy shade partition system 100 coupled to an end cap member 112 of a swimming pool is provided. The privacy shade partition system 100 may comprise a swimming pool structure having one or more vertical pool wall panels 110 that are covered at their vertical extent by a plurality of end cap members 112. A joint 114 is formed where each of the vertical pool wall panels 110 adjoin and where each of the end cap members 112 adjoin.

The privacy shade partition system 100 may further comprise a privacy shade structure 120 removably coupled to one of the end cap members 112 via one or more bracket coupling mechanisms 128. The length of any given end cap member 112 may vary and so the privacy shade structure 120 may be length adjustable in order to accommodate the variation in length of the given end cap member 112 to which it is coupled. It is advantageous to provide a privacy shade structure 120 that spans the length of the pool structural object to which it is being coupled as this will provide the maximum amount of privacy and shade to the user.

Further, if the privacy shade structure 120 spans multiple end cap members 112 arranged at angles relative one another, then the privacy shade structure 120 would not easily accommodate coupling to two distinct surfaces arranged at different angles relative one another without making the design of the privacy shade structure 120 unnecessarily complex and reducing the utility of the swimming pool generally. For instance, the bracket coupling mechanisms 128 would be required to have rotational function to accommodate the unique coupling angles and the remaining planar body of the privacy shade structure 120 would cut across a portion of the usable surface area of the pool.

Therefore, the privacy shade structure 120 may comprise a plurality of frame members 122 that are length-adjustable to accommodate the length of the given end cap member 112. Further, it is advantageous to provide a privacy shade structure 120 that may be height-adjustable in order to provide added utility to the user when accommodating the varying angles of the sun throughout each day and each season. Additionally, the user may encounter circumstances where privacy may only be obtained by increasing the height of the privacy shade structure 120. Therefore, the plurality of frame members 122 of the privacy shade structure 120 may be height-adjustable as desired by the user.

In order to effectuate the height and length-adjustability of the frame members 122, each of the frame members 122 may comprise a horizontal portion and a vertical portion that couple together at a corner point forming roughly a 90 degree angle. The horizontal and vertical portions may couple together at a single joint forming a sharp 90 degree angle or the portions may couple together along a continuous rounded corner enclosing 90 degrees of arc. Each horizontal portion of a given frame member 122 may couple to a horizontal portion of another frame member 122. Similarly, each vertical portion of a given frame member 122 may couple to a vertical portion of another frame member 122.

Each of these coupling points between vertical portions and between horizontal portions may comprise an interlocking adjustment mechanism that serves as the means of height and length-adjustability. For instance, each frame member 122 may comprise two terminal ends of which one is a male terminal end and the other is a female terminal end. The horizontal and vertical portions may comprise either the male or female terminal end. The degree to which the male terminal end is inserted within the female terminal end dictates the degree to which the height and length of the privacy shade structure 120 is adjusted. Means by which the male and female terminal ends may be interlocked into position relative one another include, but are not limited to, collar locks, depressible tabs and apertures, pins and apertures and the like and any combination thereof.

The privacy shade structure 120 may further comprise a coupling perimeter 124 enclosing a semi-porous screen 126 therein. The coupling perimeter 124 may couple to each of the frame members 122 indirectly as illustrated in FIG. 1 using an elastic tethering material that couples together loops formed into both the plurality of frame members 122 and the coupling perimeter 124. Alternatively, the coupling perimeter 124 may couple directly to each of the frame members 122 via directly coupling the loops of the coupling perimeter 124 to hooks formed into the interior portion of each of the frame members 122.

The coupling perimeter 124 may serve as a means of securing and/or finishing the periphery of the semi-porous screen 126. Specifically, the coupling perimeter 124 may be fabricated from the same material as the semi-porous screen 126 and may be defined by the portion of the semi-porous screen 126 that is folded over onto itself to provide a robust peripheral portion of the semi-porous screen 126 for coupling to the frame members 122 and stretching during height and length-adjustment of the frame members 122.

Alternatively, the coupling perimeter 124 may be made from a material that is separate in form and/or substance from that of the semi-porous screen 126. In such a case, the semi-porous screen 126 may be coupled to the coupling perimeter 124 via stitching, rivets and the like or any combination thereof. Regardless of the material selected, the coupling perimeter 124 may comprise a plurality of apertures formed therein which are disposed symmetrically thereabout as shown in FIG. 1. In some embodiments, the apertures may be disposed symmetrically in each of the corners of the coupling perimeter 124. In other embodiments, the apertures may be disposed symmetrically about the entire extent of the coupling perimeter 124. However, it is advantageous to arrange the apertures in such a manner so as to not interfere with the structure and function of the height and length-adjustable interlocking mechanisms of the frame members 122 as they are manipulated relative one another. Therefore, it is preferably, but not necessary, to avoid utilizing apertures in the coupling perimeter 124 in areas adjacent the interlocking mechanisms of the frame members 122.

The semi-porous screen 126 may comprise a mesh-type structure with arrayed apertures formed therein with a uniform pitch. The size of the apertures and center-to-center pitch of the mesh-type structure may allow the entirety of the semi-porous screen 126 to transmit an amount of sunlight that provides an effective sun protection factor (SPF). The range of SPF values provided by the semi-porous screen 126 may be at least 15 but no more than 60 when arranged adjacent to a user's skin. An SPF value of less than 15 may not be advantageous as it would not provide enough protection for the user from the sun to prevent sunburn, sun stroke and other sun overexposure conditions. An SPF value of greater than 60 may be not advantageous as it would not allow enough sunlight to reach the skin of the user to provide adequate vitamin D and light tanning of the user's skin.

The shape of the arrayed apertures of the mesh-type structure of the semi-porous screen 126 may take any suitable form including, but not limited to, square, circular, diamond, rectangular, hexagonal, octagonal and the like. The dimensions of the arrayed apertures may fall within a range between 0.03 inches and 0.125 inches. Aperture dimensions smaller than 0.03 inches may be not advantageous as it would not allow enough sunlight to reach the skin of the user to provide adequate vitamin D and light tanning of the user's skin. Aperture dimensions larger than 0.125 may not be advantageous as it would not provide enough protection for the user from the sun to prevent sunburn, sun stroke and other sun overexposure conditions.

The bracket coupling mechanisms 128 may each have a horizontal portion that is to be arranged adjacent and parallel a horizontal portion of the end cap member 112. A vertical portion of the bracket coupling mechanism 128 may extend orthogonally from each terminal end of the horizontal portion such that the vertical portions are arranged adjacent and parallel a vertical portion of the end cap member 112. In use, the vertical and horizontal portions of the bracket coupling mechanism 128 may utilize frictional engagement to secure the privacy screen structure 120 to the end cap member 112. The terminal end of each vertical portion of the bracket coupling mechanism 128 may comprise a tab to be secured underneath the end cap member 112 to prevent disengagement of the privacy screen structure 120 from the end cap member 112.

In order to selectively secure and remove the privacy screen structure 120 to and from the end cap member 112, the bracket coupling mechanism 128 may be length-adjustable between a closed position and an open position. In the open position, the bracket coupling mechanism 128 may be removed from the end cap member 112 or may be disposed around the end cap member 112. If the bracket coupling mechanism 128 is disposed around the end cap member 112 in the open position, then the bracket coupling mechanism 128 may be manipulated into the closed position to semi-permanently secure it to the end cap member 112 until placed back into the open position.

Figure 2:
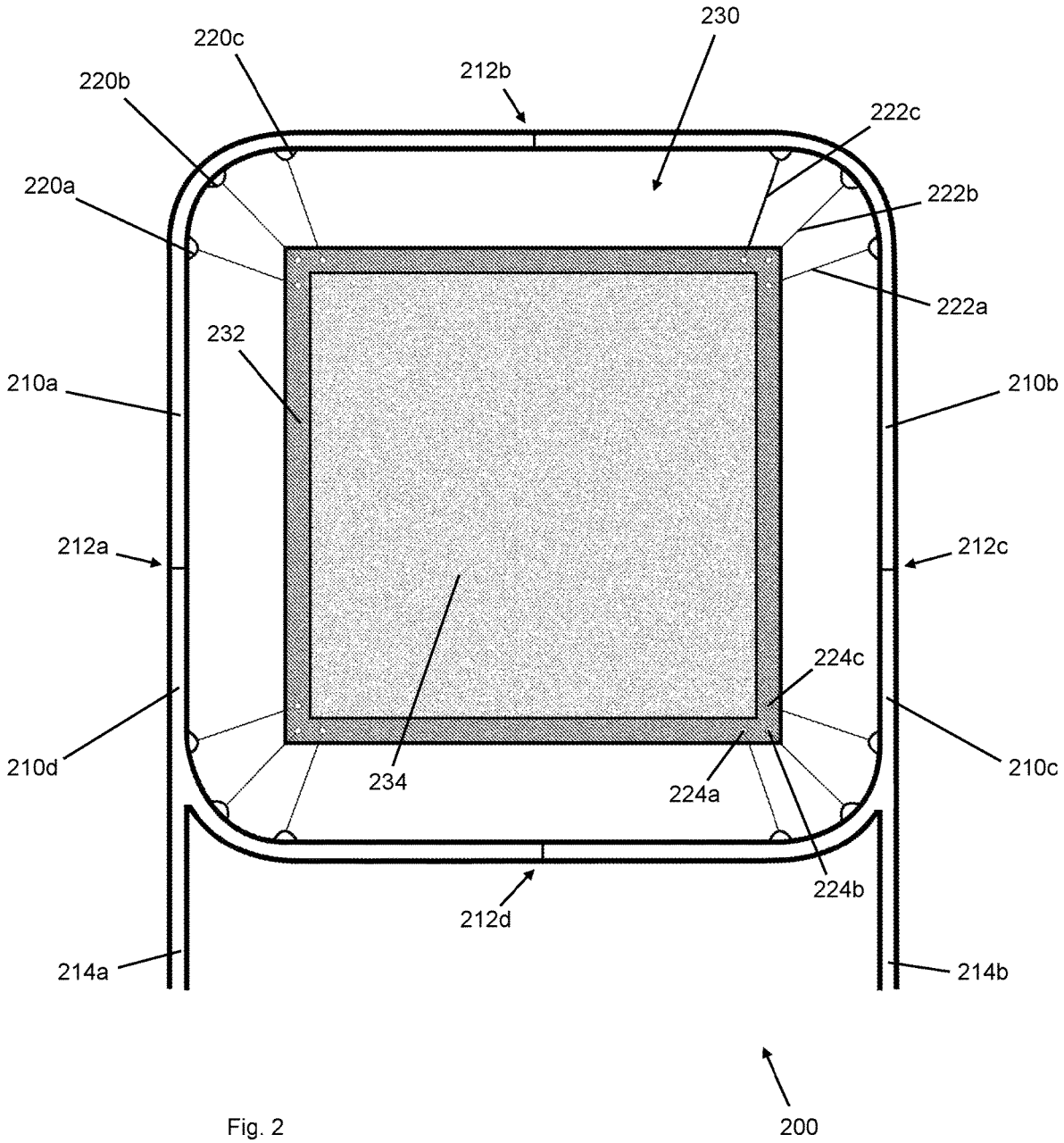
FIG. 2 illustrates a detailed view of a privacy shade partition system having a plurality of frame members and a privacy shade in accordance with some embodiments of the present invention.

As shown in FIG. 2, a detailed view of a privacy shade partition system 200 having a plurality of frame members 210*a*-210*d* and a privacy shade 230 is provided. The privacy shade partition system 200 may comprise the plurality of frame members 210*a*-210*d* each separated from an adjacent frame member by a given interlocking adjustment mechanism 212*a*-212*d*. The frame members 210*a*-210*d* may collectively form a rectangular shape that couple to a swimming pool structure (not shown) via legs 214*a*, 214*b* extending between the underside of the frame towards the swimming pool structure.

The frame members 210*a*-210*d* may be fabricated unitary with the legs 214*a*, 214*b* or may be structurally separate therefrom and coupled thereto. Preferably, the frame members 210*a*-210*d* may be structurally separate from the legs 214*a*, 214*b* and further may be removably coupled to and from the legs 214*a*, 214*b*. Such a configuration allows for reduced manufacturing cost, ease of construction of the privacy shade partition system 200 and ease of disassembly and storage thereof. Further, such a configuration would allow each of the individual frame members 210*a*-210*d* to be structurally modular and therefore interchangeable with one another during construction of the system 200.

Each of the frame members 210*a*-210*b* may couple together in an adjustable manner such that the combined horizontal dimensions and combined vertical dimensions of the frame may be adjusted by manipulation of the frame members 210*a*-210*d* at the associated interlocking adjustment mechanisms 212*a*-212*d*. By increasing or decreasing the horizontal and/or vertical dimensions of the frame members 210*a*-210*d*, the horizontal and/or vertical dimensions of the privacy shade 230 may be proportionally adjusted, thereby allowing a user of the system 200 to height and length-adjust the shade 230 to meet their privacy and shade needs.

In order to effectuate the height and length-adjustability of the frame members 210*a*-210*d*, each of the frame members 210*a*-210*d* may comprise a horizontal portion and a vertical portion that couple together at roughly a 90 degree angle. The horizontal and vertical portions may couple together at a single orthogonal joint forming a sharp 90 degree angle or the portions may couple together along a continuous rounded corner enclosing 90 degrees of arc. Each horizontal portion of a given frame member 210*a*-210*d* may couple to a horizontal portion of another frame member. Similarly, each vertical portion of a given frame member 210*a*-210*d* may couple to a vertical portion of another frame member.

Each of these interlocking adjustment mechanisms 212*a*-212*d* between vertical portions and between horizontal portions may serve as the means of height and length-adjustability. For instance, each frame member 210*a*-210*d* may comprise two terminal ends of which one is a male terminal end and the other is a female terminal end. The horizontal and vertical portions may comprise either the male or female terminal end. The degree to which the male terminal end is inserted within the female terminal end dictates the degree to which the height and length of the privacy shade 230 is adjusted. Means by which the male and female terminal ends may be interlocked into position relative one another include, but are not limited to, collar locks, depressible tabs and apertures, pins and apertures and the like and any combination thereof.

In order to height and length-adjust each frame member 210*a*-210*d* equally, it is preferred to utilize preset equidistant adjustment steps at each interlocking adjustment mechanism 212*a*-212*d* between frame members 210*a*-210*d*. Consequently, the degree to which frame members 210*a* and 210*d* are height-adjusted via interlocking adjustment mechanism 212*a* may be equal to the degree to which frame members 210*b* and 210*c* are height-adjusted via interlocking adjustment mechanism 212*c*. Similarly, the degree to which frame members 210*a* and 210*b* are length-adjusted via interlocking adjustment mechanism 212*b* may be equal to the degree to which frame members 210*c* and 210*d* are length-adjusted via interlocking adjustment mechanism 212*d*. Such a configuration ensures that the privacy shade partition system 200 remains structurally symmetric and thereby structurally robust in the face of inclement weather such as high winds.

On an interior portion of each of the frame members 210*a*-210*d* there may be disposed one or more attachment points 220*a*-220*c* which extend inwardly from the interior portion of each frame member towards the privacy shade 230. Each of the attachment points 220*a*-220*c* may be coupled to the privacy shade 230 via associated elastic tethering elements 222*a*-222*c* and coupling apertures 224*a*-224*c* as shown in FIG. 2. In this embodiment, the attachment points 220*a*-220*c* may be formed as open or closed loops that allow for the elastic tethering elements 222*a*-222*c* to be coupled thereto. The elastic tethering elements 222*a*-222*c* may be advantageous to utilize as a safety feature to prevent a user's body part from becoming stuck between the privacy shade 230 and the frame members 210*a*-210*d* via the elastic nature of the tethering elements.

Alternatively, the attachment points 220*a*-220*c* may be directly coupled to the coupling apertures 224*a*-224*c* without utilizing any of the intermediary elastic tethering elements 222*a*-222*c*. In such an embodiment, the attachment points 220*a*-220*c* may be formed as open loops or hooks that allow for the coupling apertures 224*a*-224*c* to directly accept the open loop or hook shape of the attachment points 220*a*-220*c*. In any embodiment, it is advantageous not to position any attachment points 220*a*-220*c* adjacent the interlocking adjustment mechanisms 212*a*-212*d* so as not to interfere with the structural and functional aspects of the height and length-adjustable interlocking adjustment mechanisms 212*a*-212*d*.

For instance, if attachment points 220*a*-220*c* were included adjacent the interlocking adjustment mechanisms 212*a*-212*d*, then the adjustment mechanisms would not be able to fully height and length-adjust given the physical presence of the attachment points 220*a*-220*c* on adjacent frame members 210*a*-210*d* would limit the insertion capability between the male and female terminal ends of the frame members. Therefore, it is advantageous to provide one or more attachment points 220*a*-220*c* in the area along the interior of the frame members 210*a*-210*d* that is between the interlocking adjustment mechanism 212*a*-212*d* and the 90 degree corner of the frame members. It is further advantageous that the attachment points 220*a*-220*c* be arranged symmetrically about the 90 degree corner of each frame member 210*a*-210*d* so that the privacy screen 230 maintains equal and opposite force vectors being applied to it in both horizontal and vertical dimensions which ensures the structural integrity of the privacy screen 230 and thereby the proper shading and privacy functions thereof.

The privacy screen 230 of the partition system 200 may comprise a coupling perimeter 232 enclosing a semi-porous screen 234. Each of the coupling apertures 224*a*-224*c* may be disposed within the coupling perimeter 232 in order to provide a robust substrate for coupling to the attachment points 220*a*-220*c* of the frame members 210*a*-210*d*. The coupling perimeter 232 may be fabricated from the same or similar material as the semi-porous screen 234 and, further, may comprise the fabrication material of the semi-porous screen 234 folded over itself at least once to provide the robust structure that supports the load-bearing capacity of the coupling apertures 224*a*-224*c*. In some embodiments, the fabrication material of the coupling perimeter 232 may be structurally continuous with that of the semi-porous screen 234. Further, the fold over of the coupling perimeter 232 may be secured in place by various stitching techniques through each layer of folded material. Alternatively, the folded material may be secured in place by installation of a plurality of flush apertured rivets through each layer of the folded material which in turn forms a coupling aperture 224*a*-224*c* within each associated flush apertured rivet.

The semi-porous screen 234 may comprise a mesh-type structure with arrayed apertures formed therein with a uniform pitch and spacing. The size and center-to-center distance of the apertures of the mesh-type structure may allow the entirety of the semi-porous screen 234 to transmit an amount of sunlight that provides an effective sun protection factor (SPF) value. The range of SPF values provided by the semi-porous screen 234 may be at least 15 but no more than 60 when arranged adjacent to a user's skin. An SPF value of less than 15 may not be advantageous as it would not provide enough protection for the user from the sun to prevent sunburn, sun stroke and other sun overexposure conditions. An SPF value of greater than 60 may be not advantageous as it would not allow enough sunlight to reach the skin of the user to provide adequate vitamin D and light tanning of the user's skin.

The shape of the arrayed apertures of the mesh-type structure of the semi-porous screen 234 may take any suitable form including, but not limited to, square, circular, diamond, rectangular, hexagonal, octagonal and the like. The dimensions of the arrayed apertures may fall within a range between 0.03 inches and 0.125 inches. Aperture dimensions smaller than 0.03 inches may be not advantageous as it would not allow enough sunlight to reach the skin of the user to provide adequate vitamin D and light tanning of the user's skin. Aperture dimensions larger than 0.125 inches may not be advantageous as it would not provide enough protection for the user from the sun to prevent sunburn, sun stroke and other sun overexposure conditions.

The arrayed apertures of the semi-porous screen 234, regardless of the SPF value and dimensions, may be structured so as to provide one-way visibility to a user of the pool. Specifically, the arrayed apertures may comprise a structural design that allows the user to see outside of the swimming pool through the screens 234 but that does not allow an observer outside of the swimming pool to see through the screens 234. Such a configuration would be advantageous as it would allow the user to see outside of the bounds of their swimming pool while not allowing external observers to see within the bounds of the swimming pool which provides both utility and privacy to the user.

Given the typical user is within 10 feet of the perimeter of the swimming pool and the typical observer is much greater than 10 feet from the perimeter of the swimming pool, it is advantageous that the semi-porous screen 234 comprises arrayed apertures that allow transmission of enough visible light to produce a visible line of sight for a user within feet from the screen 234. Similarly, it is advantageous that the semi-porous screen 234 comprises arrayed apertures that do not allow transmission of enough visible light to produce a visible line of sight for a user viewpoint greater than 10 feet from the screen 234. This visible line of sight threshold is the functional equivalent of the structural dimensions of the arrayed apertures falling within the range between 0.03 inches and inches as described above.

Figure 3:
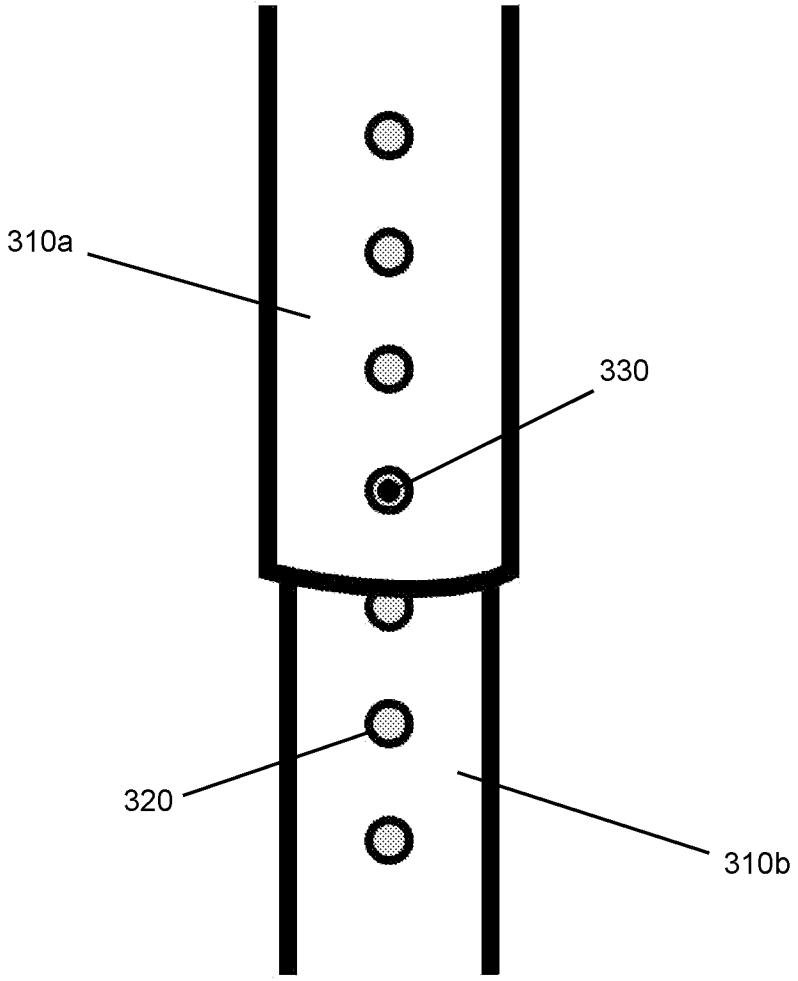
FIG. 3 illustrates a detailed view of a frame member adjustment mechanism of a privacy shade partition system in accordance with some embodiments of the present invention.

As shown in FIG. 3, a detailed view of a frame member adjustment mechanism 300 of a privacy shade partition system is provided. The frame member adjustment mechanism 300 may comprise a first interlocking frame member 310*a* and a second interlocking frame member 310*b*. The first interlocking frame member 310*a* is illustrated in FIG. 3 as having a female terminal end while the second interlocking frame member 310*b* is illustrated as having a male terminal end. As such, the male terminal end of the second interlocking frame member 310*b* is shown as being inserted within the female terminal end of the first interlocking frame member 310*a*. Alternatively, the first interlocking frame member 310*a* may comprise the male terminal end and the second interlocking frame member 310*b* may comprise the female terminal end.

The frame member adjustment mechanism 300 may further comprise one or more series of successive apertures 320 and a locking pin 330. The apertures 320 may be arranged along each of the terminal ends of the first and second interlocking frame members 310*a*, 310*b* such that each of the apertures are equidistant from each successive aperture, thereby allowing the frame member adjustment mechanism 300 to be height and length-adjusted in equal steps by the user. Further, each of the apertures 320 may be formed through both sides of each the first and second interlocking frame members 310*a*, 310*b*.

The locking pin 330 may be inserted through an aperture 320 selected by the user. Specifically, the locking pin 330 may pass through one or both sides of each of the first and second interlocking frame members 310*a*, 310*b* that define the given aperture 320. In some embodiments, the locking pin 330 may be manually removed from and inserted through an aperture 320 as selected by the user after making the desired length adjustments between the first and second interlocking frame member 310*a*, 310*b*. In other embodiments, the locking pin 330 may be spring-loaded and may only pass through one surface of the first or second interlocking frame member 310*a*, 310*b* defining the aperture 320. In such a configuration, the user may depress the spring-loaded locking pin 330 to manipulate it between apertures 320 of the first or second interlocking frame member 310*a*, 310*b* and may release depression of the locking pin when the desired aperture is disposed over the locking pin.

Figure 4A:
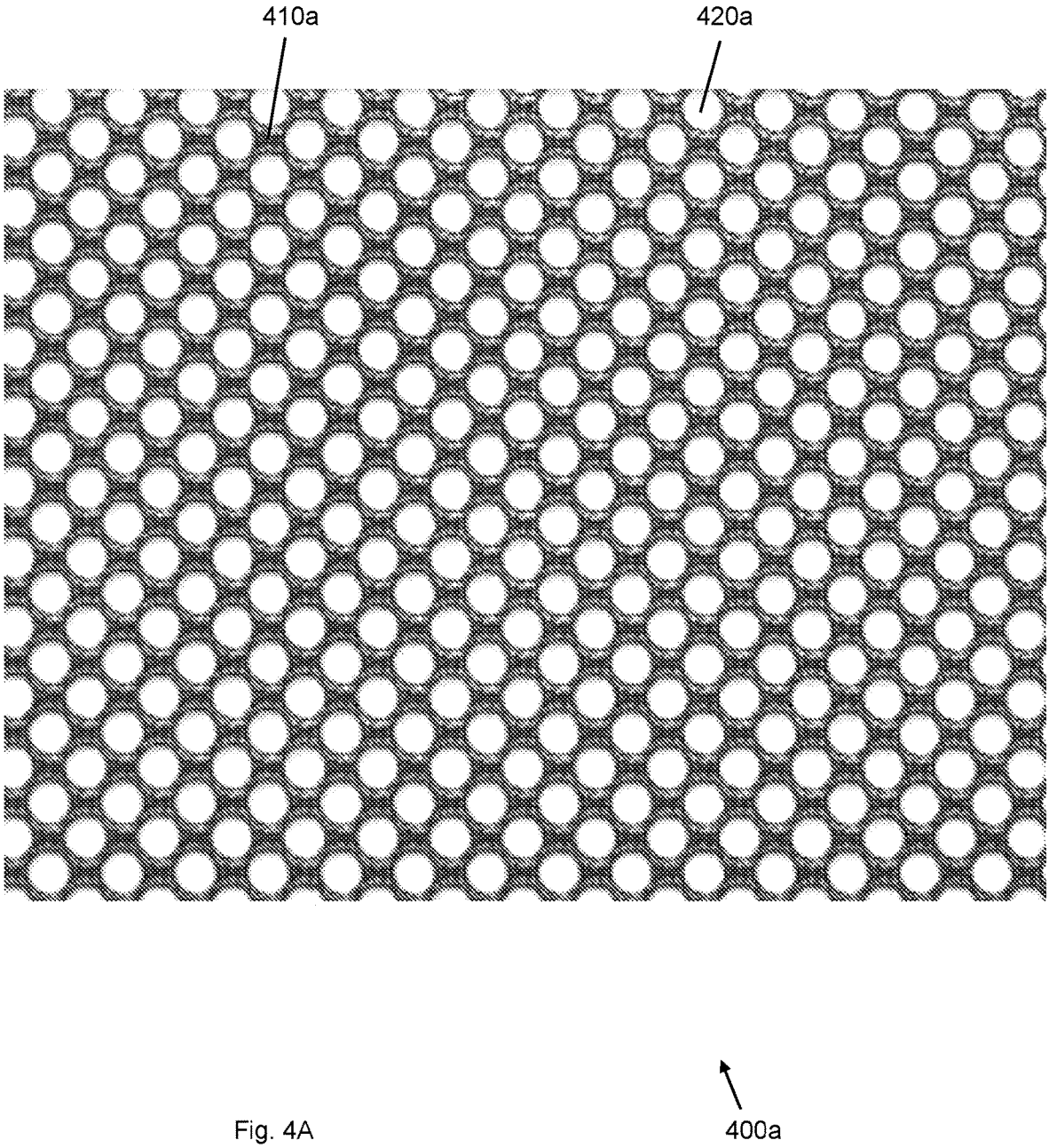
FIG. 4A illustrates a detailed view of a privacy shade mesh material of a semi-porous screen of a privacy shade partition system in accordance with some embodiments of the present invention.

As shown in FIG. 4A, a detailed view of a privacy shade mesh material 400*a* of a semi-porous screen of a privacy shade partition system is provided. The privacy shade mesh material 400*a* may comprise a mesh array 410*a* having an associated array of apertures 420*a*. The mesh array 410*a* may be made from a polymer material such as, but not limited to, polyethylene thermoplastics, low-density polyethylene, high-density polyethylene, polypropylene resin, polyethylene plastic resin, extruded polyethylene plastic and the like or any combination thereof. Polyethylene and related polymer materials are advantageous to utilize for the mesh array 410*a* given its high level of ductility, low friction, soft exterior and resistance to extreme temperature deterioration and related dry rot cracking.

The mesh array 410*a* may comprise a plurality of central portions and a plurality of branch portions. Each branch portion may couple together adjacent central portions. The center-to-center distance between central portions may be within the range of 0.1 to 0.5 inches. Center-to-center distances smaller than 0.1 inches may be not advantageous as it would not allow enough sunlight to reach the skin of the user to provide adequate vitamin D and light tanning of the user's skin. Center-to-center distances larger than 0.5 inches may not be advantageous as it would not provide enough protection for the user from the sun to prevent sunburn, sun stroke and other sun overexposure conditions.

Further, the shape of the apertures 420*a* of the mesh array 410*a* may comprise a circular shape as shown in FIG. 4A. It is advantageous to utilize a circular aperture in order to provide a shape that is symmetrically robust to external forces such as the mesh array 410*a* being stretched by height and/or length adjustment of one or more frame members of the privacy shade partition system as discussed in previous embodiments.

The dimensions of the apertures 420*a* may fall within a range between 0.03 inches and 0.125 inches. Aperture dimensions smaller than 0.03 inches may be not advantageous as it would not allow enough sunlight to reach the skin of the user to provide adequate vitamin D and light tanning of the user's skin. Aperture dimensions larger than 0.125 may not be advantageous as it would not provide enough protection for the user from the sun to prevent sunburn, sun stroke and other sun overexposure conditions.

Figure 4B:
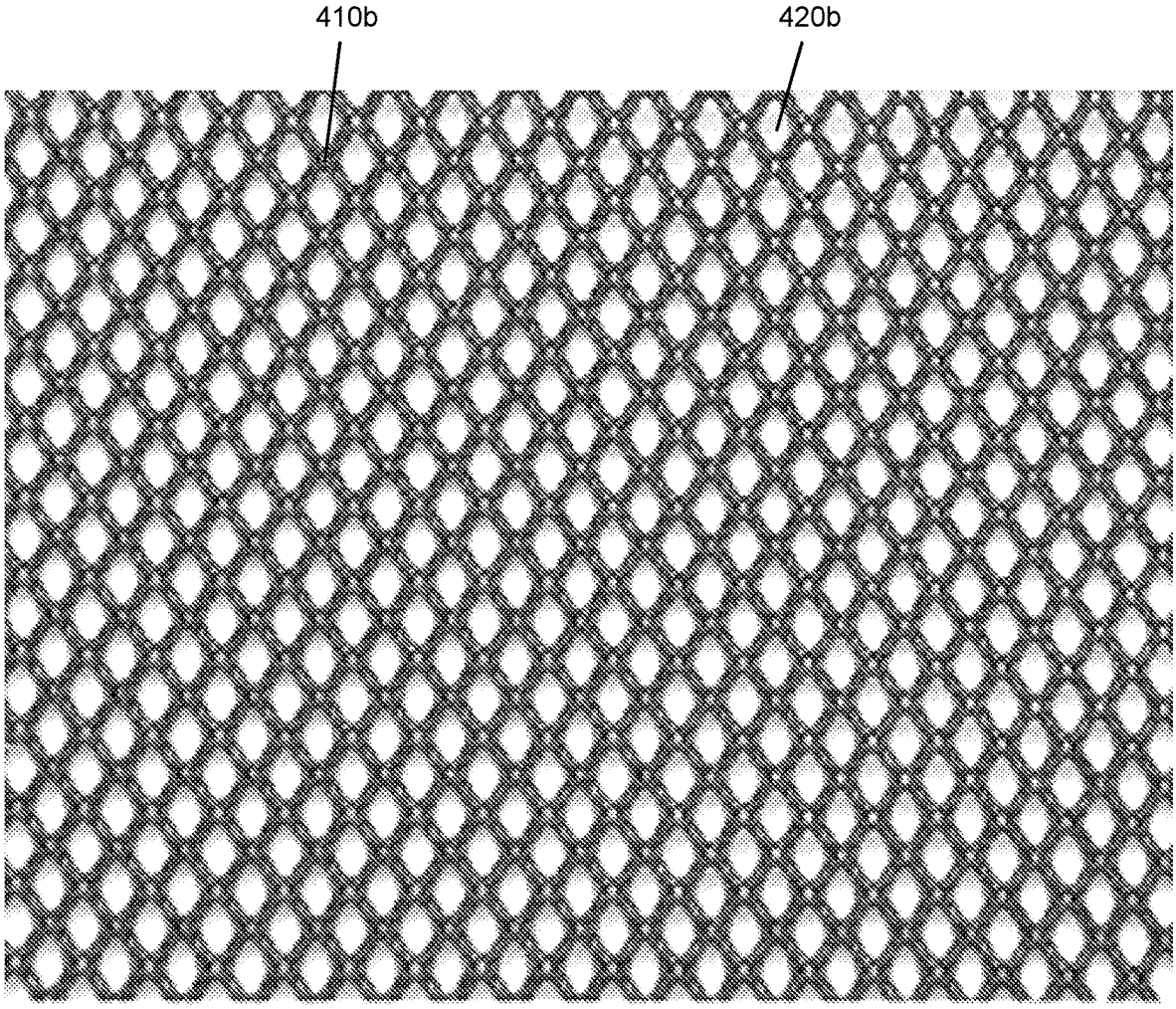
FIG. 4B illustrates a detailed view of a privacy shade mesh material of a semi-porous screen of a privacy shade partition system in accordance with some embodiments of the present invention.

As shown in FIG. 4B, a detailed view of a privacy shade mesh material 400*b* of a semi-porous screen of a privacy shade partition system is provided. The privacy shade mesh material 400*b* may comprise a mesh array 410*b* having an associated array of apertures 420*b*. The mesh material 400*b* may be similar to the mesh material 400*a* of FIG. 4A, but the shape of the apertures 420*b* of the mesh array 410*b* may comprise a diamond shape as shown in FIG. 4B. It is advantageous to utilize a diamond aperture in order to provide a shape that is particularly robust to external forces having primarily vertical or primarily horizontal components. Such a circumstance may arise when the mesh array 410*a* is being stretched by height and/or length adjustment of one or more frame members when attachment points between the frame members and the mesh array are disposed along horizontal and vertical center lines of the semi-porous screen dimensions.

Figure 4C:
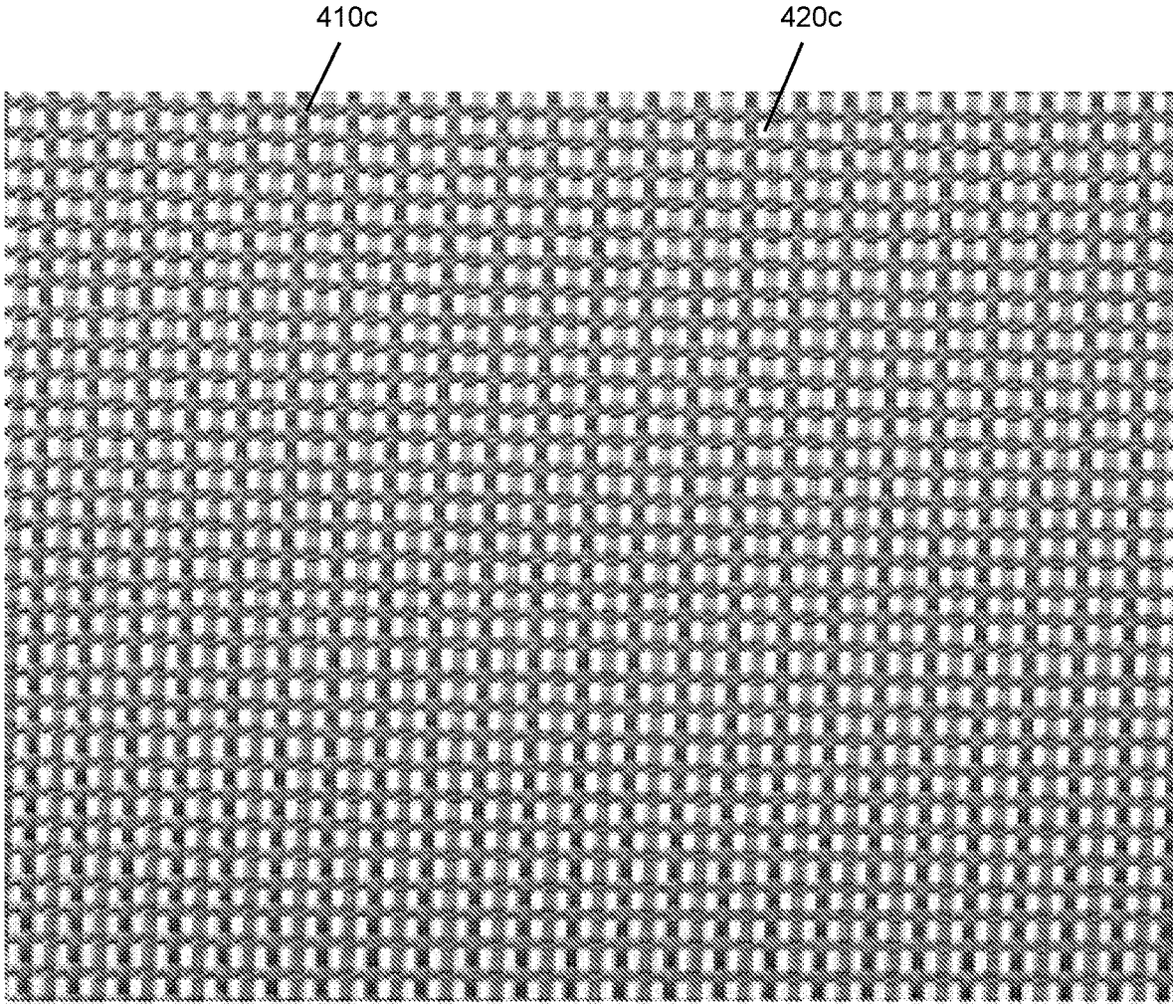
FIG. 4C illustrates a detailed view of a privacy shade mesh material of a semi-porous screen of a privacy shade partition system in accordance with some embodiments of the present invention.

As shown in FIG. 4C, a detailed view of a privacy shade mesh material 400*c* of a semi-porous screen of a privacy shade partition system is provided. The privacy shade mesh material 400*c* may comprise a mesh array 410*c* having an associated array of apertures 420*c*. The mesh material 400*c* may be similar to the mesh material 400*c* of FIG. 4A, but the shape of the apertures 420*c* of the mesh array 410*c* may comprise a rectangular shape as shown in FIG. 4C. It is advantageous to utilize a rectangular aperture in order to provide a shape that is particularly robust to diagonal external forces having similar vertical and horizontal components. Such a circumstance may arise when the mesh array 410*a* is being stretched by height and/or length adjustment of one or more frame members when attachment points between the frame members and the mesh array are disposed along the corner portions of the frame members.

Figure 5:
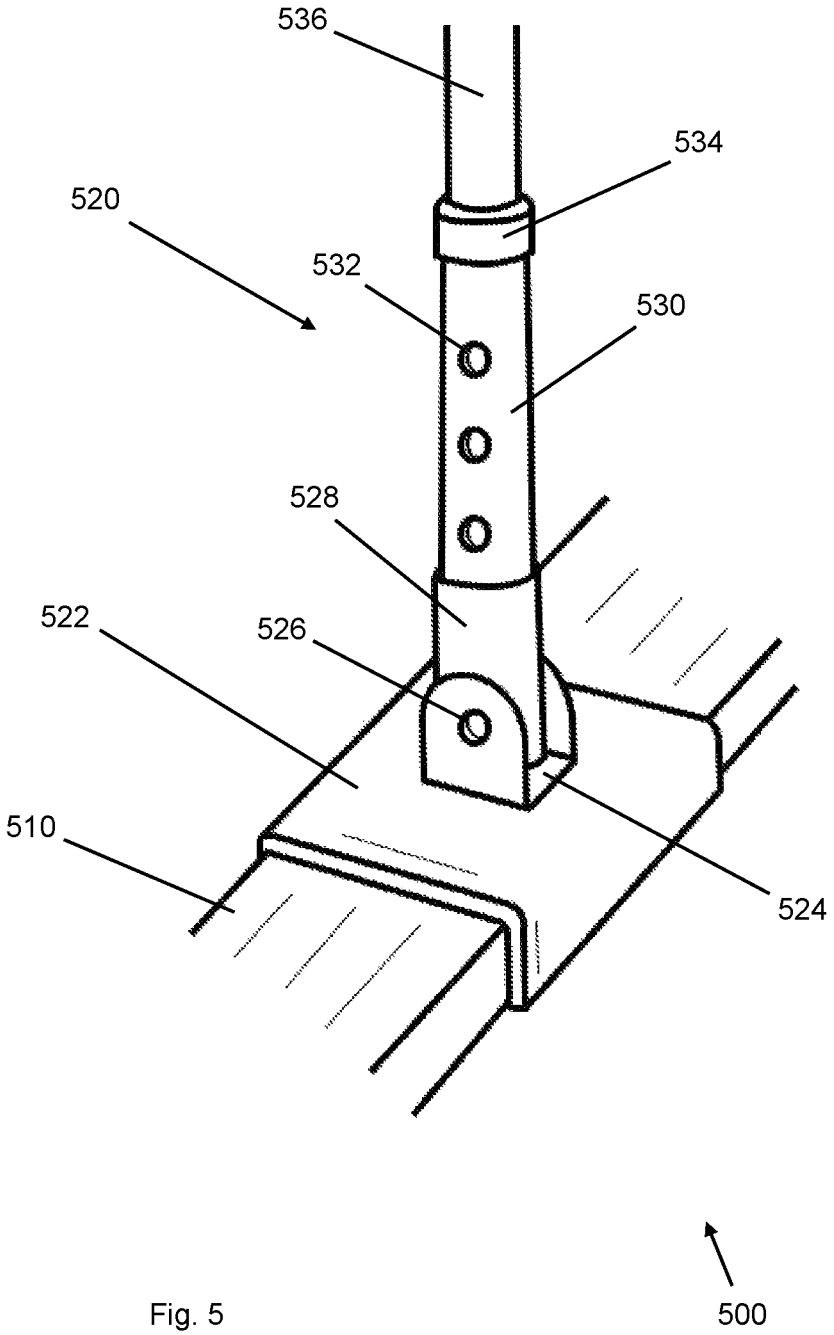
FIG. 5 illustrates a perspective view of a rotatable coupling mechanism of a privacy shade partition system coupling a privacy shade to an end cap member of a swimming pool in accordance with some embodiments of the present invention.

As shown in FIG. 5, a perspective view of a rotatable coupling mechanism 520 of a privacy shade partition system 500 coupling a privacy shade to an end cap member 510 of a swimming pool is provided. The rotatable coupling mechanism 520 may comprise a bracket coupling mechanism 522 of the privacy shade partition system 500. The bracket coupling mechanism 522 may be removably coupled to an end cap member 510 of the swimming pool. The rotatable coupling mechanism 520 may further comprise a rotational base member 524 having a horizontal portion parallel to the bracket coupling mechanism 522 and two flanges extending vertically from each side of the horizontal portion as shown in FIG. 5. The horizontal portion of the rotational use member 524 may be at least semi-permanently coupled to the bracket coupling mechanism 522.

The rotational base member 524 may serve as an anchor point about which the coupling mechanism 520 may be rotated through an angle of at least 90 degrees, but preferably through an angle of at least 180 degrees. It is advantageous to allow the coupling mechanism 520 to rotate through an angle of at least 180 in order to allow the privacy shade partition system 500 to be folded down around 90 degrees from the vertical in either direction which consequently allows for the privacy shade partition system 500 to be installed without concern for installing it backwards.

Specifically, when folded down degrees, the privacy shade partition system 500 is designed to cover the swimming pool surface in order to prevent debris from entering the pool water and to allow a user to cover the pool while the system 500 is still installed upon the bracket coupling mechanisms 522.

The rotational base member 524 may comprise a pin aperture 526 that is formed through both of the flanges of the base member 524 as well as the entirety of a base rod 528 as shown in FIG. 5. The base rod 528 may act as a robust structural support for a shaft 530 having a plurality of coupling apertures 532 that may be aligned as desired with similar coupling apertures of a leg 536 in order to height-adjust the entirety of the privacy shade partition system 500. This allows the user to height-adjust the system 500 via both the legs 536 and a privacy shade which allows for added customization of the system 500 by the user. Further, a collar 534 may act as a structural guide within which the leg 536 may slide within the shaft 530 in order to align the coupling apertures 532 as desired by the user to select a height for the entirety of the system 500.

One or more structurally robust pins may be inserted through the pin aperture 526 and coupling apertures 532 in order to secure in place other structural members of the coupling mechanism 520 relative one another. Each of these pins may take any suitable shape but are preferably one of a hairpin cotter pin, a flat cotter pin, a ring cotter pin and the like or any combination thereof. The hairpin cotter pin, also known as a bridge pin or a hitch pin clip, comprises a hairpin-shaped portion and allows for quick assembly and disassembly of various structural components of the privacy shade partition system 500. The flat cotter pin is structurally similar to the hairpin cotter pin except that the hairpin portion is flat and a ring portion is disposed at a terminal end of the pin. The ring cotter pin comprises a ring portion that is structurally discontinuous from the remainder of the pin body which is a uniform elongate rod.

In some embodiments of FIGS. 1-5, the various rigid robust structural components discussed may be fabricated from one or more materials including, but not limited to, stainless steel and similar steel alloys, zinc and the like and any combination thereof, but preferably may be fabricated from zinc-plated stainless steel. Zinc offers excellent protection from environmental elements causing corrosion and is cost-effective to source relative to chromium which is most commonly utilized. Therefore, zinc is advantageous to utilize as a plating material for the steel structural components of the privacy shade partition system given the degree to which the components of the system will be exposed to harsh environmental elements being coupled potentially year-round to the exterior of the pool.

In some embodiments of FIGS. 1-5, the semi-porous screen of the privacy shade may comprise a mesh material having one or more luminescent materials coated thereupon or impregnated therein. Such luminescent materials may include, but are not limited to, strontium aluminate, copper-activated zinc sulfide and the like or any combination thereof. It is advantageous to utilize one or more luminescent materials within the semi-porous screen in order to provide low-level nighttime illumination of the pool and the surrounding areas. Further, phosphorescent materials require adequate exposure to the sun in order to function and the privacy shade will easily meet this threshold being coupled to a swimming pool in direct sunlight.

In some embodiments of FIGS. 1-5, one or more LEDs may be utilized with one or more structural components of the privacy shade partition system in order to provide illumination thereto as desired by the user. The LEDs may be solar-powered, low-heat radiating, dynamically color-changing, intensity-selectable, sequence-lit, UV-resistant, durable to harsh environmental elements and the like or any combination thereof. It is advantageous to utilize LEDs with the privacy shade partition system in order to provide entertaining and aesthetically-appealing nighttime illumination of the swimming pool and surrounding area in a manner that is cost-effective and customizable to the user.

The specification and drawings are to be regarded in an illustrative rather than a restrictive sense. However, it will be evident that various modifications and changes may be made thereunto without departing from the broader spirit and scope of the invention as set forth in the claims. Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

Throughout this disclosure, the phrase 'modularly coupled' and similar terms and phrases are intended to convey that any element of a given class of elements may be coupled to another given element and vice versa with equal effect. For example, any extension cord of a plurality of extension cords may be modularly coupled to another extension cord and vice versa with equal effect. Further, throughout this disclosure, the phrase 'removably coupled' and similar terms and phrases are intended to convey that a given element may be iteratively coupled to and removed from another given element as desired. For example, a male plug of a first extension cord may be removably coupled to a female plug of a second extension cord as desired.

The use of the terms "a," "an," "the," and similar referents in the context of describing the disclosed embodiments (especially in the context of the following claims) are to be construed to cover both the singular and the plural, unless otherwise indicated or clearly contradicted by context. The terms "comprising," "having," "including," and "containing" are to be construed as open-ended terms (i.e., meaning "including, but not limited to,") unless otherwise noted. The term "connected," where unmodified and referring to physical connections, is to be construed as partly or wholly contained within, attached to, or joined together, even if there is something intervening. Recitation of ranges of values are merely intended to serve as a shorthand method of referring individually to each separate value falling within the range, unless otherwise indicated and each separate value is incorporated into the specification as if it were individually recited. The use of the term "set" (e.g., "a set of items") or "subset" unless otherwise noted or contradicted by context, is to be construed as a nonempty collection comprising one or more members. Further, unless otherwise noted or contradicted by context, the term "subset" of a corresponding set does not necessarily denote a proper subset of the corresponding set, but the subset and the corresponding set may be equal.

Conjunctive language, such as phrases of the form "at least one of A, B, and C," or "at least one of A, B and C," is understood with the context as used in general to present that an item, term, etc., may be either A or B or C, or any nonempty subset of the set of A and B and C, unless specifically stated otherwise or otherwise clearly contradicted by context. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, the term "plurality" indicates a state of being plural (e.g., "a plurality of items" indicates multiple items). The number of items in a plurality is at least two, but can be more when so indicated either explicitly or by context.

The use of any examples, or exemplary language (e.g., "such as") provided, is intended merely to better illuminate embodiments of the invention and does not pose a limitation on the scope of the invention unless otherwise claimed. No language in the specification should be construed as indicating any non-claimed element as essential to the practice of the invention.

Embodiments of this disclosure are described, including the best mode known to the inventors for carrying out the invention. Variations of those embodiments may become apparent to those of ordinary skill in the art upon reading the foregoing description. The inventors expect skilled artisans to employ such variations as appropriate and the inventors intend for embodiments of the present disclosure to be practiced otherwise than as specifically described. Accordingly, the scope of the present disclosure includes all modifications and equivalents of the subject matter recited in the claims appended hereto as permitted by applicable law. Moreover, although above-described elements may be described in the context of certain embodiments of the specification, unless stated otherwise or otherwise clear from context, these elements are not mutually exclusive to only those embodiments in which they are described; any combination of the above-described elements in all possible variations thereof is encompassed by the scope of the present disclosure unless otherwise indicated or otherwise clearly contradicted by context.

All references, including publications, patent applications, and patents, cited are hereby incorporated by reference to the same extent as if each reference were individually and specifically indicated to be incorporated by reference and were set forth in its entirety.

The invention claimed is:

1. A privacy shade partition system, comprising:

a plurality of frame members adjustably coupled to one another, wherein:

each of the plurality of frame members comprise a plurality of attachment points permanently coupled thereto, and the plurality of frame members are adjustably coupled to one another via a plurality of interlocking adjustment mechanisms;

a plurality of legs coupled to the plurality of frame members, wherein each of the plurality of legs comprises a bracket coupling mechanism adjustably coupled thereto; and a privacy shade coupled to each of the plurality of attachment points.

2. The privacy shade partition system of claim 1, wherein each of the plurality of frame members comprise a horizontal portion and a vertical portion.

3. The privacy shade partition system of claim 2, wherein:

the horizontal and vertical portions couple together at a corner point, and the corner point comprises a single orthogonal joint forming a 90 degree angle.

4. The privacy shade partition system of claim 2, wherein:

the horizontal and vertical portions couple together at a corner point, and the corner point comprises a continuous rounded corner enclosing 90 degrees of arc.

5. The privacy shade partition system of claim 1, wherein each of the plurality of frame members comprise a male terminal end and a female terminal end.

6. The privacy shade partition system of claim 5, wherein each of the plurality of frame members are adjustably coupled to one another via insertion of the male terminal ends of the plurality of frame members into the female terminal ends of the plurality of frame members.

7. The privacy shade partition system of claim 6, wherein each of the plurality of interlocking adjustment mechanisms are disposed at locations where the male terminal ends are inserted within the female terminal ends.

8. The privacy shade partition system of claim 6, wherein each of the plurality of interlocking adjustment mechanisms comprises:

a plurality of serially arrayed apertures formed symmetrically within the male and female terminal ends of the plurality of frame members; and a locking pin.

9. The privacy shade partition system of claim 1, wherein each of the plurality of legs comprise a rotatable coupling mechanism coupled to a bracket coupling mechanism via a rotational base member.

10. The privacy shade partition system of claim 9, wherein the rotatable coupling mechanism rotates about the rotational base member through an angle of at least 90 degrees.

11. The privacy shade partition system of claim 9, wherein the rotatable coupling mechanism comprises an elongate shaft having a first plurality of serially arrayed apertures formed symmetrically therein.

12. The privacy shade partition system of claim 11, wherein the elongate shaft couples to one of the plurality of legs via paired alignment of the first plurality of serially arrayed apertures with a second plurality of serially arrayed apertures formed symmetrically within the leg and insertion of a locking pin through one of the aligned pairs of apertures of the first and second plurality of serially arrayed apertures.

13. The privacy shade partition system of claim 1, wherein the privacy shade comprises a coupling perimeter enclosing a semi-porous screen.

14. The privacy shade partition system of claim 13, wherein the coupling perimeter comprises a plurality of coupling apertures.

15. The privacy shade partition system of claim 14, wherein each of the plurality of coupling apertures are coupled to a respective attachment point of the plurality of attachment points.

16. The privacy shade partition system of claim 13, wherein the semi-porous screen comprises a mesh structure having arrayed apertures formed therein with uniform pitch and spacing.

17. The privacy shade partition system of claim 16, wherein the arrayed apertures do not provide a visible line of sight through the semi-porous screen at a viewpoint greater than feet therefrom.

18. The privacy shade partition system of claim 16, wherein the arrayed apertures provide a visible line of sight through the semi-porous screen at a viewpoint less than 10 feet therefrom.

19. A privacy shade partition system, comprising:

a plurality of frame members adjustably coupled to one another, wherein:

each of the plurality of frame members comprise a horizontal portion and a vertical portion arranged orthogonal relative one another and permanently coupled together at a corner point, each of the plurality of frame members comprise a plurality of attachment points permanently coupled thereto, wherein at least one of the plurality of attachment points are disposed at the corner point, and each of the plurality of frame members are adjustably coupled to one another via an interlocking adjustment mechanism;

a plurality of legs coupled to the plurality of frame members, wherein each of the plurality of legs comprises a bracket coupling mechanism adjustably coupled thereto; and a privacy shade coupled to each of the plurality of attachment points.

20. A privacy shade partition system, comprising:

a plurality of frame members adjustably coupled to one another, wherein:

each of the plurality of frame members comprise a horizontal portion and a vertical portion, each of the plurality of frame members comprise a plurality of attachment points permanently coupled thereto, wherein at least one of the plurality of attachment points are coupled to the horizontal portion and at least one of the plurality of attachment points are coupled to the vertical portion, and each of the plurality of frame members are adjustably coupled to one another via an interlocking adjustment mechanism;

a plurality of legs coupled to the plurality of frame members, wherein each of the plurality of legs comprises a bracket coupling mechanism adjustably coupled thereto; and a privacy shade coupled to each of the plurality of attachment points.

* * * * *